United States Patent [19]

Zimmermann

[11] 4,194,265

[45] Mar. 25, 1980

[54] DOOR HOLDER

[75] Inventor: Waldemar Zimmermann, Velbert, Fed. Rep. of Germany

[73] Assignee: Friedr. Fingscheidt GmbH, Velbert, Fed. Rep. of Germany

[21] Appl. No.: 133

[22] Filed: Dec. 29, 1978

[30] Foreign Application Priority Data

Jan. 4, 1978 [DE] Fed. Rep. of Germany ..... 2800256

[51] Int. Cl.[2] ..... E05F 5/02

[52] U.S. Cl. ..... 16/82

[58] Field of Search ..... 16/82, 85, 86; 292/198, 292/78, 216, 262, 277

[56] References Cited

U.S. PATENT DOCUMENTS

| | | | |
|---|---|---|---|
| 2,131,339 | 9/1938 | Valletta | 16/85 |
| 3,714,677 | 2/1973 | Schmid | 16/85 |
| 3,863,967 | 2/1975 | Carrier | 16/82 |

*Primary Examiner*—Werner H. Schroeder

*Assistant Examiner*—Doris L. Troutman

*Attorney, Agent, or Firm*—Michael J. Striker

[57] ABSTRACT

A door holder includes an elongated housing which has at least one first fixing member which is located on the housing in correspondence with a desired open position of the door. An elongated guiding sleeve is movably mounted in the housing for movement lengthwise thereof in response to movement of the door. At least one second fixing member is movable together with the sleeve along the housing in response to movement of the door between the open and closed positions thereof. The second fixing member is movable between a first position in which it is disengaged from the first fixing member and a second position in which the second fixing member engages the first fixing member to thereby arrest the door in the open position thereof. The second fixing member does not have any direct contact with the elongated sleeve during movement thereof between the first and second positions.

23 Claims, 2 Drawing Figures

DOOR HOLDER

BACKGROUND OF THE INVENTION

The present invention relates to door holders.

More particularly the present invention concerns a door holder for a door of a vehicle.

It is known in the prior art to provide a door of a vehicle with an arrangement for holding the door in an open position thereof (e.g., half open, or fully open).

Such an arrangement (see, for example, German Offenlegungsschfit 26 19171) includes an elongated housing which has sets of opposite recesses (i.e., corresponding to the number of the open positions of the door) located on opposite side walls of the housing. The door is connected with a steering arm, which in its turn is fixedly connected with a guiding member movably mounted between the opposite side walls of the housing. Thus, when the door is moved from the closed into the open position thereof the steering arm displaces the guiding member (i.e., sleeve) along the elongation of the housing. The sleeve has two opposite open ends which are directed towards the opposite side walls of the housing, respectively. Two bodies (i.e., balls) are installed in the interior of the sleeve and adjacent to the open ends thereof. The bodies are movable together with the sleeve relative to the housing and in response to the movement of the door between its open and closed positions. The balls are movable along the elongation of the sleeve, that is, transversely to the elongation of the housing. A spring is located in the sleeve between the bodies so as to normally urge the same away from each other and towards the corresponding side walls of the housing. Thus, the spring urges the bodies into engagement with the opposite side walls of the housing. When the door moves from the closed into the open position the sleeve moves correspondingly along the elongation of the housing so that the bodies slide along the corresponding inner surfaces of the opposite side walls of the housing. Once the sleeve assumes its position in alignment with one set of the opposite recesses the bodies under the biasing force of the spring slide along the inner surface of the sleeve in the opposite directions so as to engage (i.e., snap) the corresponding opposite recesses in the side walls of the housing to thereby arrest the door in the corresponding open position thereof. The housing is provided at least at the area of the recesses with a groove which receives lubricant (which is filled into the housing) reducing friction between the inner surface of the recess and the outer surface of the corresponding body.

Usually, this groove is so curved as to correspond to the outer configuration of the body. The housing and the sleeve are of light metal. The lower side of the housing (i.e., floor) is provided with another longitudinal groove which has a U-shape.

The side walls of the housing may be provided with a number of the recesss (preferably four—namely two sets of the opposite recesses) which are spaced from one another. If the longitudinal groove has the breadth of 20 mm then the recesses have the diameter of 18 mm.

It has been recognized that the bodies during their sliding movement along the inner surface of the sleeve tend to abrase the same, which fact eventually negatively effects reliability and effectiveness of the door holder in operation.

SUMMARY OF THE INVENTION

It is a general object of the present invention to avoid the disadvantages of the prior art arrangements for holding a door of a vehicle in an open position.

More particularly, it is an object of the present invention to provide such a door holder in which the direct contact between guiding bodies and the inner surface of the guiding member is eliminated.

In pursuance of these objects and others which will become apparent hereafter, one feature of the present invention resides in providing an elongated housing which has at least one first fixing member located on said housing in correspondence with a desired open position of the door, and guiding means which are movable along the housing in response to movement of the door between its closed and at least one open position. The guiding means include an elongated sleeve which is movable in said housing lengthwise thereof in response to movement of the door and at least one second fixing member which is movable together with said sleeve along said housing in response to movement of the door into said one open position. The second fixing member is movable between a first position, in which said second fixing member is disengaged from said first fixing member and a second position, in which said second fixing member engages said first fixing member to thereby arrest the door in said one open position thereof. There are further provided means for preventing direct contact between said second fixing member and said sleeve during movement of said second fixing member between said first and second positions. The second fixing member is urged into said second position by resilient means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
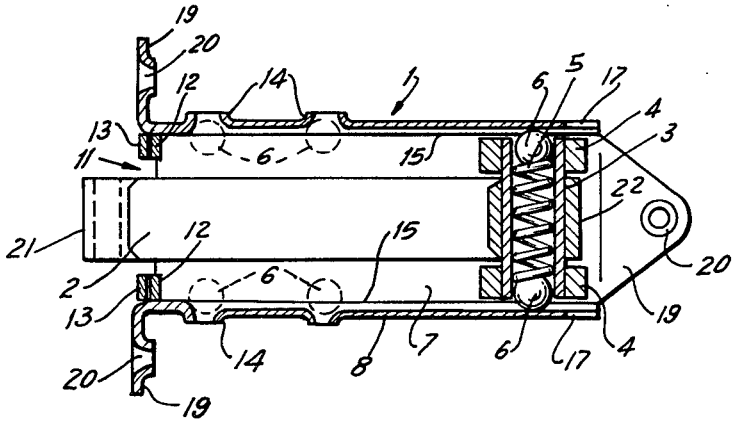
PRIOR ART FIG. 1
FIG. 1 is a sectional view of a prior-art door holder.

FIG. 1 shows a prior-art door holder designated in toto by the reference numeral 1. The holder includes a housing which is provided with a steering arm 2, which is connected with its one end to a sleeve 3. The sleeve 3 is provided with two balls 6 which are spaced apart from each other by a spring 5. The housing is provided with sets (e.g., two sets) of opposite recesses 14 which are located on the opposite side walls of the housing. When the steering arm 2 moves along the housing between the side walls thereof (i.e., in response to movement of the door between its open and closed positions) the balls 6 slide along the side walls of the housing until the sleeve 3 is in alignment with a set of the recesses 14. Once the sleeve 3 is in alignment with two opposite recesses 14 the balls 6 under the biasing force of the spring 5 snap into the corresponding recesses 14 to thereby arrest the steering arm 2 (i.e., the door) in such a position.

It is shown in the FIG. 1 that the balls 6 are in direct contact with the inner surface of the sleeve 3. During their movement the balls 6 abrase and wear the inner surface, or at least the end portions of the sleeve 3. The abrasion of the inner surface of the sleeve 3 lead to deteriorating of the holding quality of the door holder.

Figure 2:
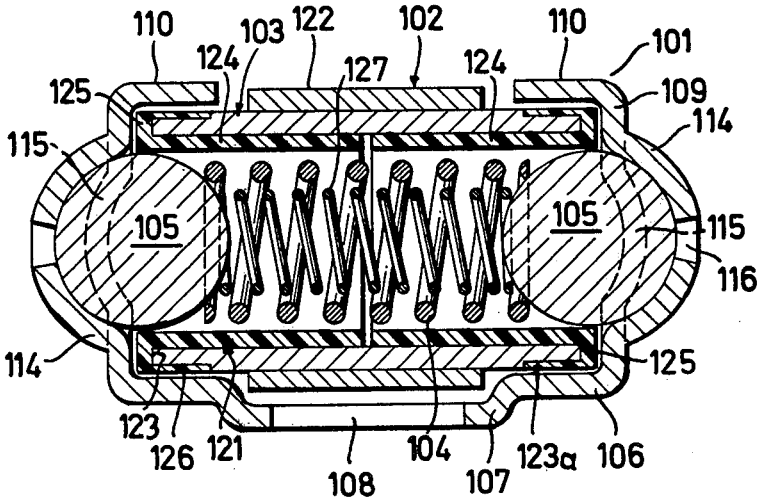
FIG. 2 is a sectional view of door holder in accordance with the present invention.

Referring now to the FIG. 2, it may be seen that the reference numeral 101 designates a housing. A steering arm is designated by the reference numeral 102, and is connected to a sleeve 103. The sleeve 103 is of aluminum. There is provided a spring 104 inside the sleeve 103 between two balls 105 which are located at the opposite open ends of the sleeve 103. The interior of the housing 101 is filled with lubricant.

The lower side of the housing 101 is provided with a longitudinal groove 107 which has a plurality of throughgoing holes 108 which are separated one from another along the elongation of the housing 101.

The longitudinal groove 107 has a U-shaped cross-section and is operative to increase the rigidity of the housing 101. Provision of holes 108 renders it possible to considerably reduce the weight of the housing 101. The lower side 106 (i.e., the floor) of the housing 101 is defined by side walls 109 which at the upper ends thereof are provided with bent portions 110. The bent portions 110 are spaced from each other so as to bound a space therebetween. The bent portions 110 extend substantially parallel to the lower side 106. The space between the bent portion 110 corresponds to the width of the steering arm 102. In fact, the space between the bent portions 110 slightly exceeds the width of the steering arm 102 so as to eliminate any contact between the arm 102 and the end faces of the bent portions 110. The front portion of the housing 101 is so shaped as to prevent any withdrawal of the sleeve 103 from the housing. (See the projections 13 shown in FIG. 1.) However, the steering arm 102 moves in the housing 101 unobstructedly as shown in FIG. 1. The projections 13 shown in FIG. 1 are directed normally respective to the side walls of the housing and into the interior thereof. Each side wall 109 of the housing 101 is provided with at least one recess 114 (preferably two such recesses) which are pressed on the side wall 109 outwardly relative to the interior of the housing 101. Each recess 114 is so configurated as to be able to receive therein at least a portion of the corresponding ball 105. In other words, the recess 114 serves as a catch for the ball 105 when the latter moves with the sleeve 103 along the elongation of the housing. Location of the recesses 114 corresponds to the open position of the door. It is to be understood that there might be provided two and more sets of the opposite recesses. The number of the sets of the opposite recesses depends upon the number of the open positions of the door (usually a door of vehicle has two open positions, that is half open and fully open). Each side wall 109 has at least one longitudinal groove 115 which extends along the recess 114. This groove 115 is operative to receive lubricant, so as to prevent any dry friction between the ball 105 and the inner surface of the recess 114. The recess 114 may be provided with a throughgoing hole 116. The dirt which is accumulated in the housing 101 is pushed out of the housing 101 through the hole 116 by the corresponding ball 105 which is urged towards the inner surface of the recess 114 by the spring 104. The housing 101 is of sheet steel and is provided with two fastening members (see elements 19, 20 shown in FIG. 1). The steering arm 102 is a one-piece flat steel bar which has at its front end, corresponding to the front portion of the housing, an eyelet (see the eyelet 21 shown in FIG. 1) for fixing the steering arm 102 on the door. The other end of the steering arm 102 is provided with a runner 122, which is fixedly connected to the sleeve 103.

In order to avoid the direct contact between the balls 105 and the inner surface of the sleeve 103 during movement of the door between its closed and open positions the sleeve 103 is provided with a layer 121 of synthetic plastic material which covers at least the inner surface of the sleeve 103. The layer 121 has flanges 123 which embrace the sleeve 103 from both end faces thereof and at least partially cover the outer surface of the sleeve 103. Thus, the metal-to-metal contact between the balls 105 and the sleeve 103 is eliminated. The synthetic plastic material for the layer 121 has to have a relatively smaller coefficient of friction as opposed to that of the balls 105. The balls 105, therefore, slide to and from the recesses 114 along the synthetic plastic layer 121. The lubricant in the sleeve has to be heat-resisting, in other words the lubricant has to withstand without any changes the increase of the temperature, which takes place when the door is lacquered. It is especially advantageous, therefore, to use polyamide reinforced by glass fibers which constitute about 30% of the overall weight of the lubricant.

The synthetic plastic layer 121 renders it possible to provide slipping of the lubricant from the sleeve 103 into the recesses 114 and into the longitudinal grooves 115 so as to prevent the dry friction between the balls 105 and the inner surface of the recesses 114. The process of slipping of the lubricant from the sleeve 103 is similar to a pumping effect during which a small, however sufficient amount of the lubricant is pushed out of the sleeve 103. It is essential that the system is reliably sealed, so as to avoid any exiting of the lubricant during the process of lacquering of the door. The amount of the lubricant in the sleeve 103 is sufficient for 100,000 movements of the door.

The present invention eliminates any metal friction between the spring (i.e., when the same is in a compressed condition) and the inner surface of the sleeve, since the spring does not have any direct contact in any of its condition with the sleeve. Instead, when the spring 104 is compressed, in response to the corresponding movement of the door, the spring 104 contacts the synthetic plastic layer 121, so that the frictional resistance of the spring considerably decreases.

In accordance with a preferred embodiment of the present invention, the synthetic plastic layer 121 consists of two cylindrical parts 124. Each part 124 has a portion 125 which is beaded over the corresponding end portion of the sleeve 103. Each part 124 is inserted in the sleeve 103 from the corresponding open end thereof. It is preferable to arrange the parts 124 on the sleeve 103 so as to prevent any contact between these separate parts. In fact these parts may be spaced from each other upon installation thereof on the sleeve 103 by a relatively small distance. The outer surface of the sleeve 103 is provided at each end portion thereof with a circular groove 123*a*. The circular groove 123*a* receives the beaded portion 126 of the layer 121. It is advantageous to thermically press the separate parts 124 on the sleeve 103, so that the synthetic plastic material of the layer 121 remains inert to the temperature increase even during the process of lacquering of the door. Needless to say, that the synthetic plastic material of the layer has to resist chemical influence of the lubricant. In accordance with another advantageous feature of the preferred embodiment there is provided an additional spring 127, which may have relatively stronger or weaker biasing force than that of the spring 104. It is advantageous, however, to provide the outer spring 104 with a relatively stronger biasing force. The spring 127 extends between the balls 105 inside the outer spring 104. The springs are actuated independently one from the other. Such an arrangement of the springs renders it possible to choose a desired optimum of the biasing force applied on the balls 105. It is also possible to choose the most convenient fatigue level for the helical springs inserted one into the other. Any engagement between the members of different springs is excluded since the helical springs 104 and 127 are chosen with different (i.e., opposite) inclination of the members.

The present invention is especially advantageous in different systems which work utmostly noiseless and without any abrasion between the parts which are movable relative to one another.

It will be understood that each of the elements described above, or two or more together, may also find a useful application in other types of door holders differing from the types described above.

While the invention has been illustrated and described as embodied in a door holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that , from the standpoint of prior art, fairly constitute essential characteristics of the generic or specific aspects of this invention.

What is claimed as new and desired to be protected by Letters Patent is set forth in the appended claims:

1. A door holder, particularly for a door of a vehicle, comprising an elongated housing having at least one first fixing member located on said housing in correspondence with a desired open position of the door; guiding means movable along said housing in response to movement of the door between its closed and at least one open position thereof, said guiding means including an elongated sleeve movable in said housing lengthwise thereof in response to movement of the door, at least one second fixing member movable together with said sleeve along said housing in response to movement of the door into said one open position, said second fixing member being movable between a first position, in which said second fixing member is disengaged from said first fixing member and a second position in which said second fixing member engages said first fixing member to thereby arrest the door in said one open position thereof; means for preventing direct contact between said second fixing member and said sleeve during movement of said second member between said first and second positions; and resilient means for normally urging said second fixing member from said first position into said second position.

2. A holder as defined in claim 1, wherein said guiding means further include a steering arm fixedly mounted on said sleeve and operatively connected to the door.

3. A holder as defined in claim 1, wherein said housing having two side walls extending substantially parallel to each other, said side walls being spaced one from the other so as to define an interior of the housing, said sleeve being located in said interior substantially transversely to the elongation of the housing so that open ends of said sleeve face said side walls of the housing, respectively.

4. A holder as defined in claim 3, wherein said first fixing member includes at least one recess on at least one of said side wall of the housing.

5. A holder as defined in claim 4, wherein each of said side walls is provided with at least one recess, said recesses being located opposite each other.

6. A holder as defined in claim 5, wherein each of said side walls is provided with at least two recesses spaced one from the other along the elongation of said housing, said recesses on one side wall being located opposite the corresponding recesses on the other side wall of said housing.

7. A holder as defined in claim 5, wherein said second fixing member includes at least one body having at least portion of the outer surface thereof substantially corresponding to the inner surface of said recess adapted to receive said body in said second position to thereby arrest the door in said one open position.

8. A holder as defined in claim 7, wherein second fixing member includes two bodies, each of said recesss being adapted to correspond to and to receive the corresponding body in said second position to thereby arrest the door in said one open position.

9. A holder as defined in claim 8, wherein said preventing means include a layer of synthetic plastic material covering at least the inner surface of said sleeve so as to prevent any direct contact between the sleeve and said second fixing member.

10. A holder as defined in claim 9, wherein said bodies are inserted into said sleeve, said urging means including at least one spring located in said sleeve between said bodies and urging the same in opposite directions outwardly away from the sleeve into engagement with the inner surface of the opposite side walls of the housing, respectively.

11. A holder as defined in claim 10, wherein said layer covers the inner surface of said sleeve and at least partially the outer surface thereof.

12. A holder as defined in claim 9, wherein said synthetic plastic material comprises polyamide reinforced by a predetermined amount of glass fibers.

13. A holder as defined in claim 12, wherein 30% of the overall weight of said layer constitutes glass fibers.

14. A holder as defined in claim 11, wherein said layer includes at least two separate parts separately installed on said sleeve.

15. A holder as defined in claim 14, wherein each of said parts is provided with a flanged portion operative for at least partially embracing the upper surface of said sleeve.

16. A holder as defined in claim 15, wherein said outer surface of said sleeve is provided at the corresponding end portions thereof with circumferential grooves for receiving said flanged portions of the corresponding separate parts of said layer, respectively.

17. A holder as defined in claim 16, wherein said layer is thermically pressed on said sleeve.

18. A holder as defined in claim 8, wherein each of said body has a ball-shaped configuration.

19. A holder as defined in claim 8, wherein said resilient means includes at least one spring located in said sleeve between said bodies so as to normally urge the latter apart from each other and into said second position thereof with a first predetermined biasing force.

20. A holder as defined in claim 19, wherein said resilient means further include another spring located in said sleeve between said bodies so as to normally urge the latter apart from each other and into said second position thereof with a second predetermined biasing force.

21. A holder as defined in claim 20, wherein said first predetermined force of said one spring differs from said second predetermined force of said other spring.

22. A holder as defined in claim 21, wherein said other spring has the spring elements inclined in direction opposite to that of said one spring.

23. A holder as defined in claim 22, wherein said one spring extends inside said other spring.

* * * * *